US005391130A

United States Patent [19]

Green et al.

[11] Patent Number: 5,391,130

[45] Date of Patent: Feb. 21, 1995

[54] LEG EXERCISER

[76] Inventors: Edward J. Green, 238 Wolf Ridge Close, Edmonton, Alberta, Canada, T5T 5M6; Gerald R. Kendall, 267 Varsity Estates Gr., Calgary, Alberta, Canada, T3B 4C8; Mark Lumbard, 1631-15th Avenue S.W., Calgary, Alberta, Canada, T3C 0Y3; Arvind Naran, 501 Adsum Drive, Winnipeg, Manitoba, Canada, R20 0W8

[21] Appl. No.: 730,919

[22] PCT Filed: Feb. 2, 1990

[86] PCT No.: PCT/CA90/00036

§ 371 Date: Oct. 3, 1991

§ 102(e) Date: Oct. 3, 1991

[87] PCT Pub. No.: WO90/08572

PCT Pub. Date: Aug. 9, 1990

[30] Foreign Application Priority Data

Feb. 3, 1989 [GB] United Kingdom ..... 8902470

[51] Int. Cl.[6] ..... A63B 22/00; A63B 69/18

[52] U.S. Cl. ..... 482/71; 482/51; 482/112

[58] Field of Search ..... 482/51, 52, 53, 54, 482/70, 71, 111, 112, 113

[56] References Cited

U.S. PATENT DOCUMENTS

| | | | |
|---|---|---|---|
| 2,068,578 | 1/1937 | Stronach | 482/112 |
| 3,475,021 | 10/1969 | Ruegsegger | 482/70 |
| 3,756,595 | 9/1973 | Hague | 482/51 |
| 4,376,532 | 3/1983 | Hunstad | 482/71 |
| 4,396,189 | 8/1983 | Jenkins | 482/51 |
| 4,609,190 | 9/1986 | Brentham | 482/113 |
| 4,915,373 | 4/1990 | Walker | 482/70 |

*Primary Examiner*—Stephen R. Crow

*Attorney, Agent, or Firm*—Murray E. Thrift; Adrian D. Battison; Stanley G. Ade

[57] ABSTRACT

An exercise apparatus is used for leg exercises, and particularly for exercising the muscles used in ice skating. The apparatus has a frame with two four bar linkages arranged side by side. Each linkage carries a foot pad. A resistance unit is attached to each linkage to resist movement of the linkage in both directions. The resistance unit is preferably a double acting hydraulic cylinder connected to variable flow control valves to vary the resistance to linkage movement.

16 Claims, 5 Drawing Sheets

LEG EXERCISER

The present invention relates to exercise apparatus of the type comprising:

a frame;

two first arms pivotally connected to the frame;

two second arms pivotally connected to respective ones of the first arms at positions spaced from the connections of the first arms to the frame;

two tie rods, each pivotally connected to the frame and a respective one of the second arms so as to provide, with the first and second arms and the frame, two four bar linkages;

a foot pad mounted on each second arm; and resistance means for resisting pivotal movement of each first arm with respect to the frame.

An apparatus of this type is disclosed in Canadian Patent 955,278, issued Sep. 24, 1974 to George V. Hague. The disclosed apparatus is intended to allow simulation of the leg movements in ice skating, with the apparatus applying resistance to a rearward push by the foot on a foot pad. In this known apparatus, the resistance acts only against the rearward movement of a foot pad, so that there is little effect in exercising the opposing muscle groups used in a forward stride. In addition, there is no provision made in the known device for adjusting the magnitude of the resistance. This limits both the training and therapeutic value of the apparatus.

The present invention is intended to address these deficiencies of the known device. Preferred embodiments of the invention are intended to provide additional improvements in other areas.

According to the present invention there is provided an apparatus of the aforementioned type that is characterized in that the resistance means is a double acting resistance means for resisting pivotal movement of each first arm with respect to the frame in both directions, and means are provided for adjusting resistance to movement provided by the resistance means.

The resistance means may, for example, be a double acting fluid cylinder with a cylinder barrel, a piston in the barrel and a piston rod extending from the piston through one end of the barrel. Fluid inlets to the barrel adjacent each end are equipped with one-way inlet valves, while outlets, also adjacent the ends of the barrel are connected to variable flow control valves for controlling the resistance to movement.

In an hydraulic system, a fluid reservoir may be provided by a tube surrounding the cylinder barrel, with the inlets communicating directly with the reservoir and return flow from the control valves discharging into the reservoir.

One particularly advantageous embodiment has the flow control valves mounted on a handle bar standard for ready access by a person using the apparatus.

The apparatus may also include adjustable stop means for varying stride length by varying the travel limits of the linkage. In one preferred form, the stop means is an adjustable stop projecting into one end of the resistance cylinder to limit piston travel.

The apparatus may also include a novel foot pad in which a sole plate carrying foot or shoe retainers is mounted rotatably on a support arm by a resilient pedestal. The support arm is itself aligned with and pivotally connected to the respective second arm to pivot upwards about a horizontal axis, transverse to the second arm. This arrangement allows the foot universal rotation on the support arm against the resistance of the pedestal. The foot may be lifted at the end of a rearward movement and during a forward movement, as in normal skating.

The geometry of the preferred embodiment has the pivot mountings between the first arm and the frame and between the tie rod and the frame spaced slightly and side by side. The pivotal connection of the tie rod to the second arm is approximately midway between the pivotal connection between the first and second arms and the foot pad. This produces a movement that is closer to a natural skating action than is the case with the known apparatus.

A further desirable feature is a handle bar for the apparatus, to be gripped by a user. The most preferred handle bar is one that can be adjusted fore and aft of the frame for the comfort of the user.

In the accompanying drawings, which illustrate exemplary embodiments of the present invention:

Figure 1:
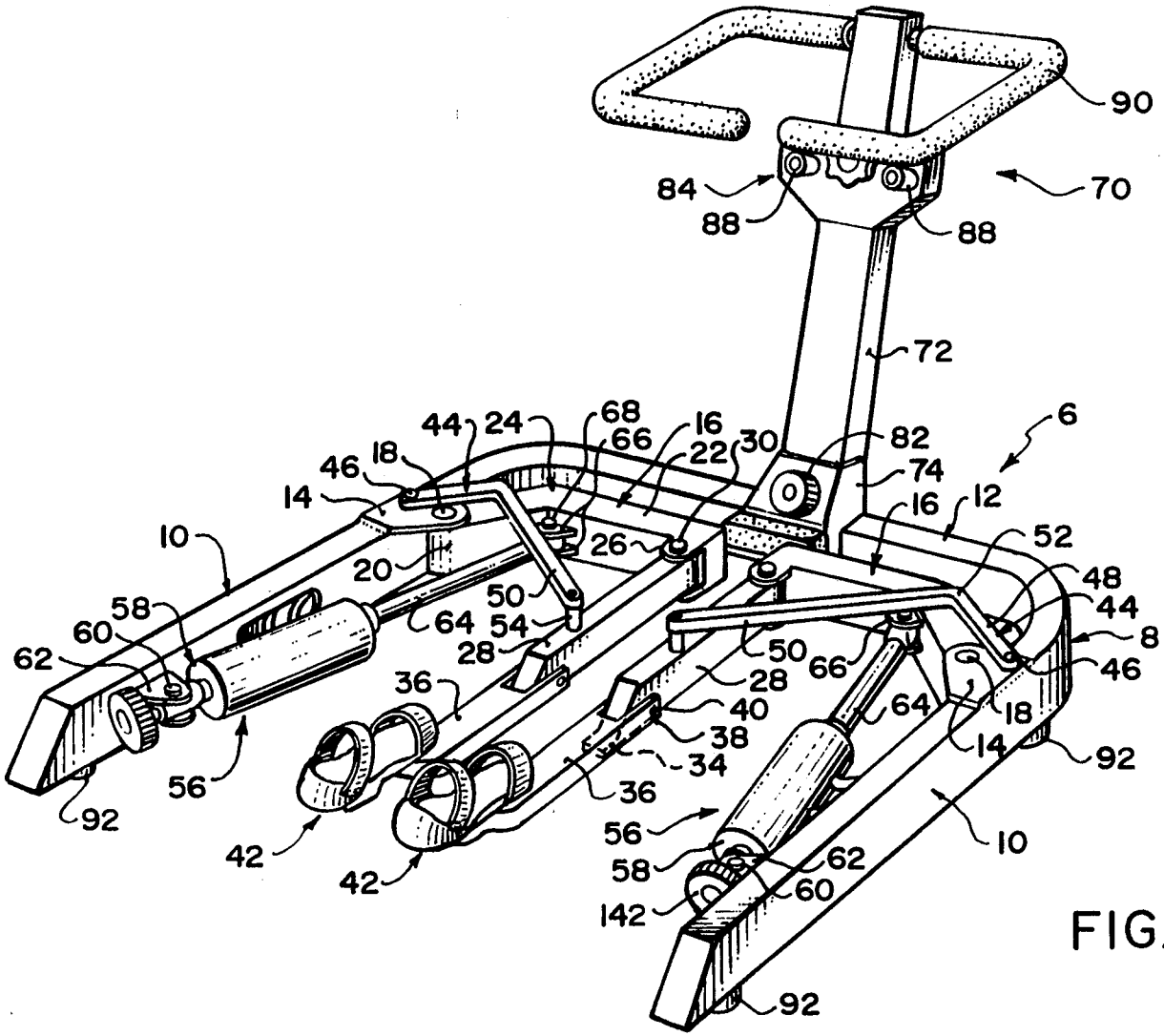
FIG. 1 is a perspective view of an exercise apparatus according to the invention.
Figure 2:
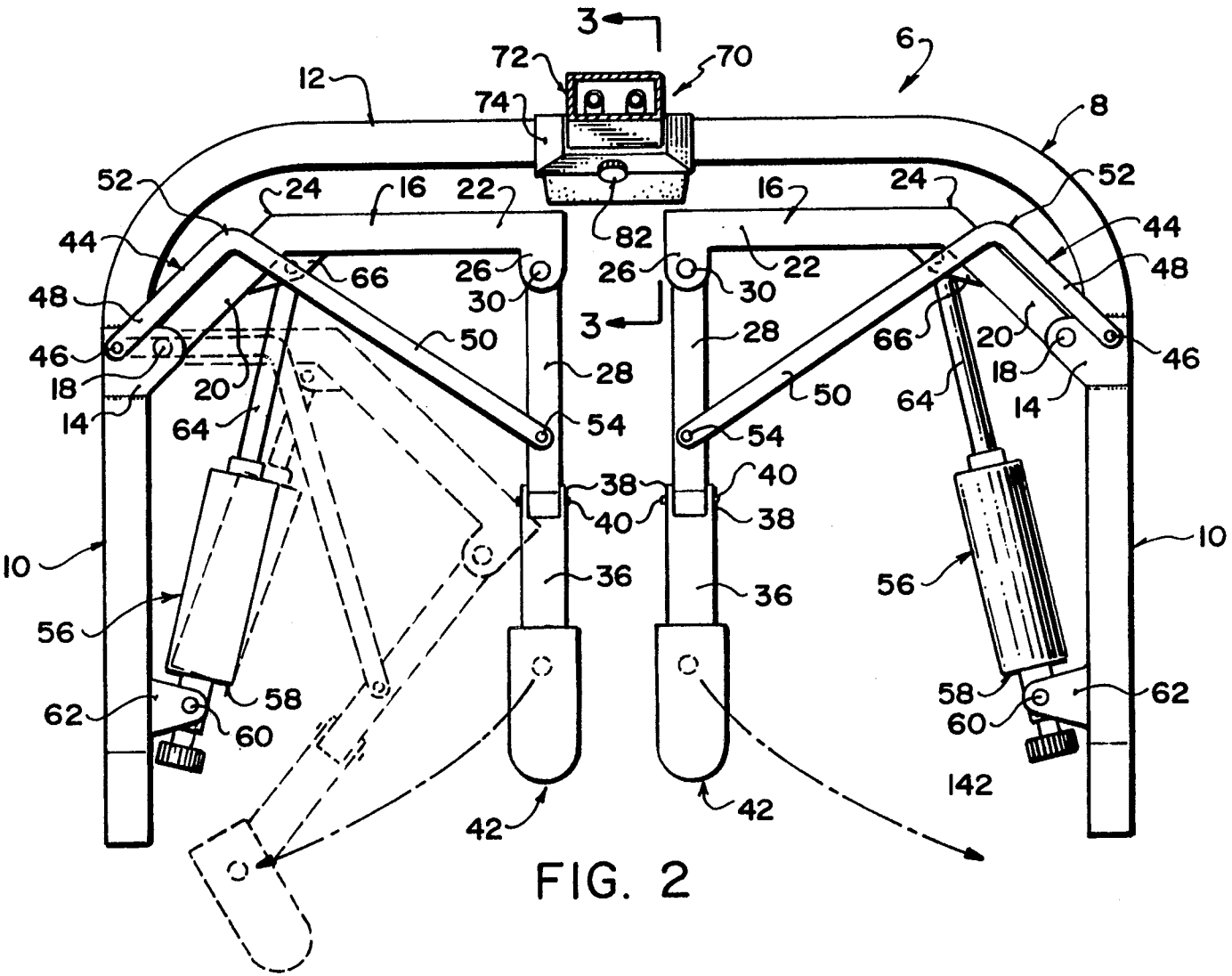
FIG. 2 is a plan view of the apparatus of FIG. 1, omitting the upper section of the handle bar.

Referring to the accompanying drawings, especially to FIGS. 1 and 2, there is illustrated an exercise apparatus 6 that includes a frame 8 in the form of a relatively wide U-shaped box section beam with two arms 10 and a centre section 12 extending between them. Each of the arms carries a pair of lugs 14 projecting to centre of the U-shaped frame adjacent the front. Each pair of lugs 14 carries a first arm 16 that is connected to the associated lugs by a vertical pivot 18. Each first arm has an outer end 20 and an inner end 22 that meet at an obtuse angled bend 24.

At the innermost end of the arm are two vertically spaced lugs 26 that are pivotally connected to a second arm 28 by a vertical pivot pin 30. The second arm 28 is straight. Its outer end slopes downwardly and terminates at the bottom in a support plate 34 that engages the under surface of a support arm 36 projecting from the end of the second arm. The end of the support arm has two lugs 38 positioned on opposite sides of the second arm 28 and connected to it by pivot pin 40. The outer end of the support arm 36 caries a foot pad 42.

Two tie rods 44 are connected to the frame by pivots 46 located laterally to the outside of the pivots 18. Each tie rod has an outer end 48 and an inner end 50 meeting at an obtuse angled bend 52. The inner end 50 of each tie rod is pivotally connected to a respective one of the second arms 28 by a pivot pin 54. This is located adjacent a point midway between the pivot 30 and the foot pad 42. This produces a four bar linkage, including the first arm 16, the second arm 28, the tie rod 44 and the section of frame between the tie rod and first arm pivots 46 and 18 respectively. The Geometry of this linkage causes the linkage to swing between the forward positions illustrated in solid line in FIG. 2 and the broken line position illustrated in broken line in FIG. 2. As will be observed, the foot pad moves in an arc to the rear and the outside during this movement. This simulates the actual path of foot movement during ice skating.

To provide resistance to leg movement, two resistance units 56 are included in the apparatus. Each of these has a head 58 on one end engaged with two pins 60 that are in turn pivotally engaged with two lugs 62 projecting inwardly from a respective side arm 10 of the frame 8. A piston rod 64 projects from the other end of the resistance unit and is connected to two lugs 64 on the inner end 22 of a respective first arm 16 by a pivot pin 68.

Also mounted on the frame is a handle bar 70. This includes a standard 72 projecting upwardly from the centre section 12 of the frame 8. A bracket 74 mounted on the frame is connected to the standard through a pivot 76 and an adjusting unit including a nut 78 carried by the lower end of the standard and a screw 80 engaged with a nut and mounted rotatably on the bracket. An adjustment knob 82 on the outside of the bracket is used for rotating the screw. Part way up the standard 72 is a console 84 that carries two resistance adjustment knobs 88 that serve, as described in the following, to adjust the resistance to movement provided by the resistance units 56. At the top of the standard is a hand grip 90. The hand grip can be adjusted fore and aft with respect to the frame by rotating the knob 82 to drive the nut 78 along the .screw 80 and tilt the standard 72 around the pivot 76.

The frame 8 is mounted on non-slip feet 92 that hold the apparatus in place while it is being used.

Figure 4:
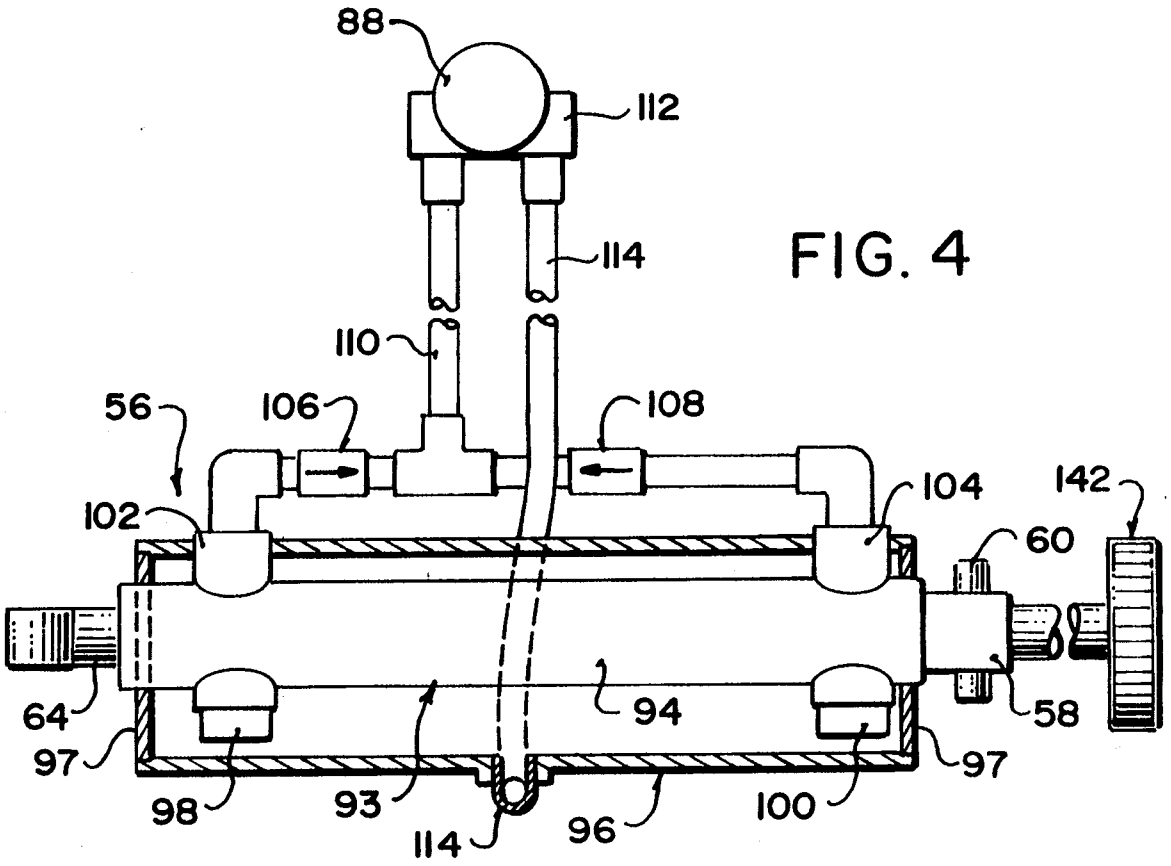
FIG. 4 is an illustration of the resistance system with the hydraulic fluid reservoir tube shown in section.
Figure 3:
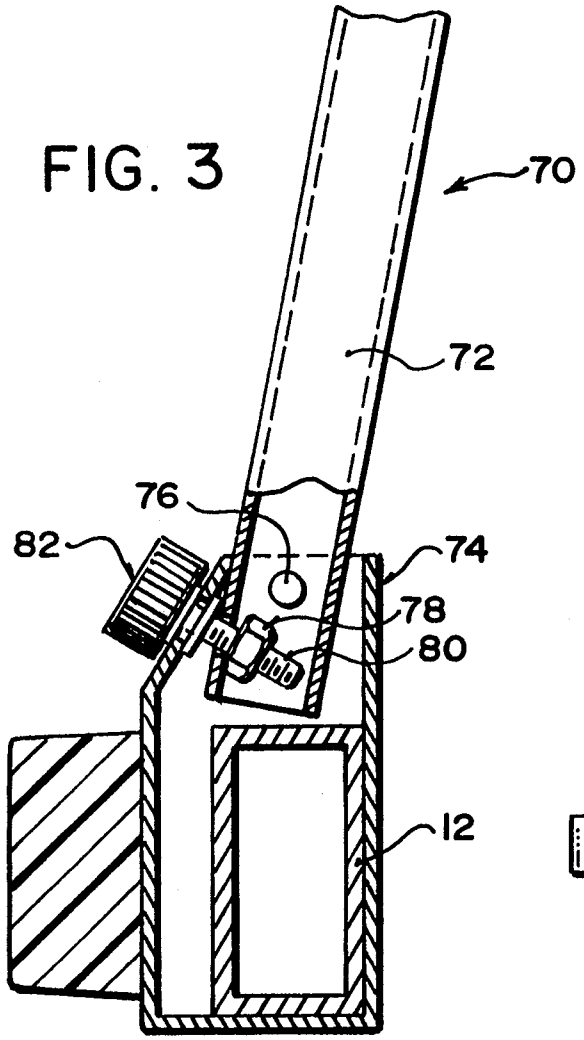
FIG. 3 is a section along line III—III of FIG. 2.
Figure 5:
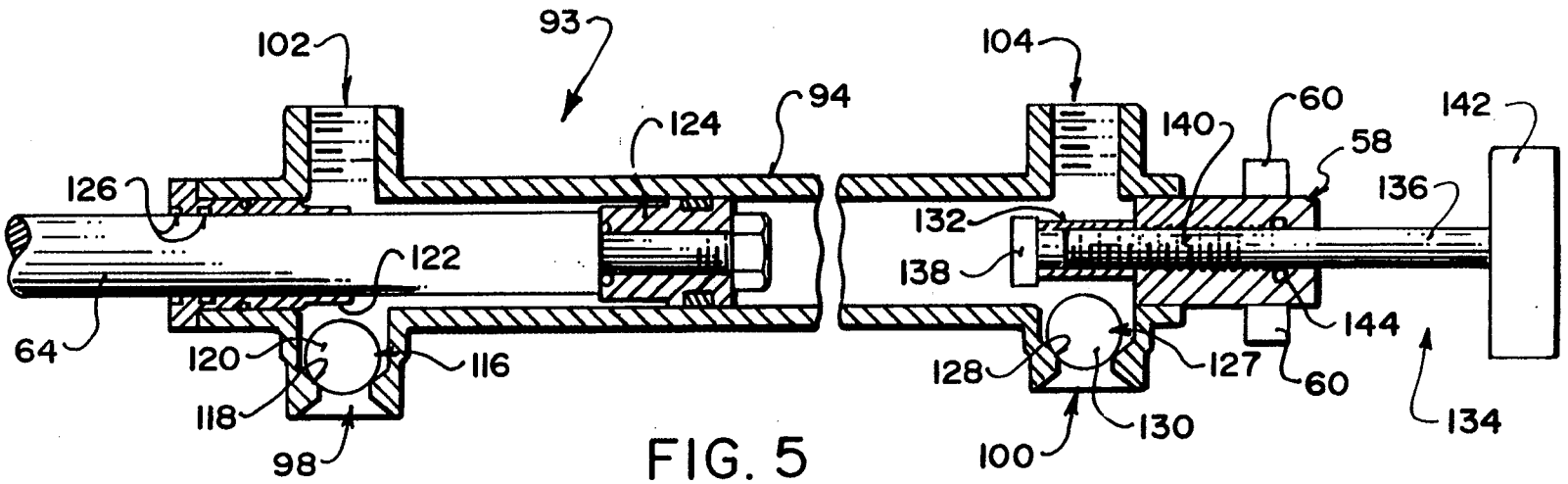
FIG. 5 is a longitudinal section of the resistance cylinder.

The construction and operation of each of the resistance units is most clearly illustrated in FIGS. 4 and 5. Each unit includes an hydraulic cylinder 93 including a cylinder barrel 94. The barrel is surrounded by a reservoir tube 96 closed at the ends by end plates 97. Near the ends of the cylinder barrel are respective fluid inlets 98 and 100 and respective outlets 102 and 104. The outlets 102 and 104 discharge through respective check valves 106 and 108 into a common line 110 leading to a flow control valve 102. The valve is of a known type that provides variable restriction to the through flow of hydraulic fluid. The valve 112 discharges into a return line 114 leading to the reservoir contained between the tube 96 and the cylinder barrel 94.

As illustrated most particularly in FIG. 5, the inlet 98 is equipped with a one-way or check valve 116. This includes an internal valve seat and a ball 120 that engages with the seat to prevent fluid flow from the cylinder barrel out of the inlet 98. The ball is retained in the inlet by a sleeve 122 that is engaged in the end of the cylinder barrel and is sealed to the piston rod 64 by seals 126.

The cylinder inlet 100 is likewise equipped with a one-way valve 127 that includes an internal valve seat 128 and a ball 130 that engages the seat to prevent flow from the inlet 100. The ball is retained in the inlet by a sleeve 132 projecting axially along the cylinder barrel 94 from the head 58.

A stride length adjuster 134 extends through the head into the cylinder barrel. This includes a rod 136 extending axially through the head and having an internal piston engaging head 138. A threaded section 140 of the rod engages a mating thread in the bore through the head 58 so that rotation of the rod will advance or retract the piston engaging head 138 in the cylinder barrel. Rotation of the rod is accomplished with a hand knob 142 mounted on the outer end of the rod. A seal 144 is engaged between the rod and the head to prevent fluid leakage from the cylinder. By adjusting the stroke limits of the piston, the stride length of the linkage is also controlled.

The embodiment of the invention illustrated in FIGS. 1 and 4 includes a single control valve for each resistance unit 56. Adjustment of the control valve adjusts the resistance of the unit to movement in both directions. On movement in a rearward direction, the piston 124 is driven towards the head 58 and drives fluid from the outlet 104, through the check valve 108 and the flow control valve, back to the reservoir. At the same time, fluid is drawn into the cylinder barrel on the opposite side of the piston, through inlet 98 and check valve 106. On the return stroke, the piston drives fluid out of the outlet 102, through the check valve 106 and the flow control valve 112 to the reservoir. It will be noted from FIG. 5 that the piston rod is fairly large in diameter, so that the actual force required to complete the return stroke is significantly less than the force required on the rearward stroke. This is in keeping with the efforts required in normal skating.

Figure 6:
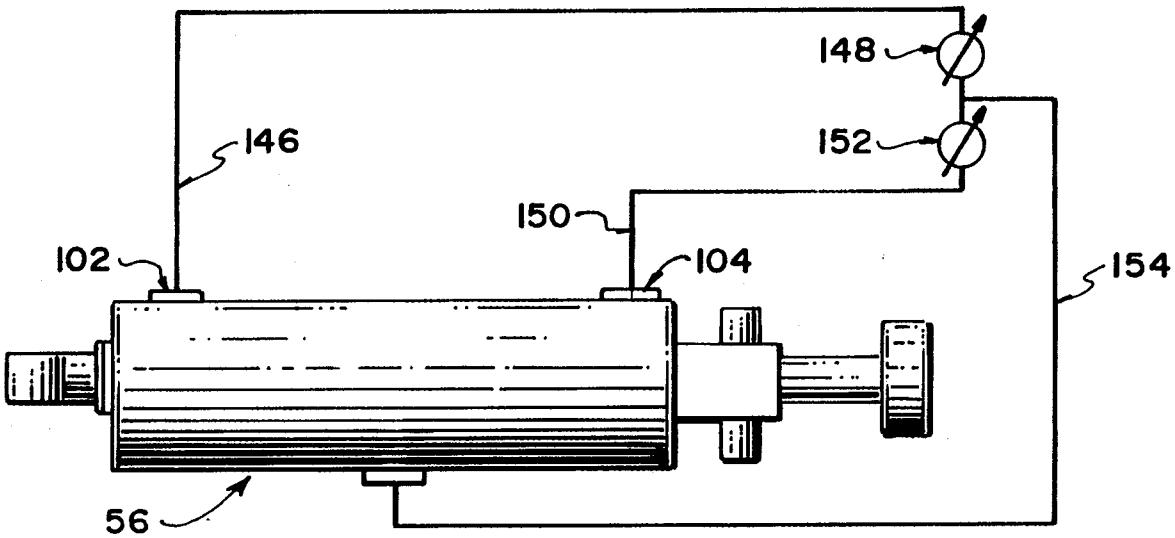
FIG. 6 is a schematic view of an alternative fluid circuit.

For some purposes, it may be desirable to provide for independent control of the force required to complete rearward and forward strides. This may be achieved using a fluid circuit as illustrated in FIG. 6. This circuit provides a supply line 146 leading from the cylinder outlet 104 to a flow control valve 148 and a separate supply line 150 leading from the cylinder outlet 104 to an independent flow control valve 152. The two control valves discharge into a common return line 154 to the reservoir. In this circuit, the two control valves 148 and 152 are independently adjustable to alter the resistance to the forward and return strokes.

Figure 7:
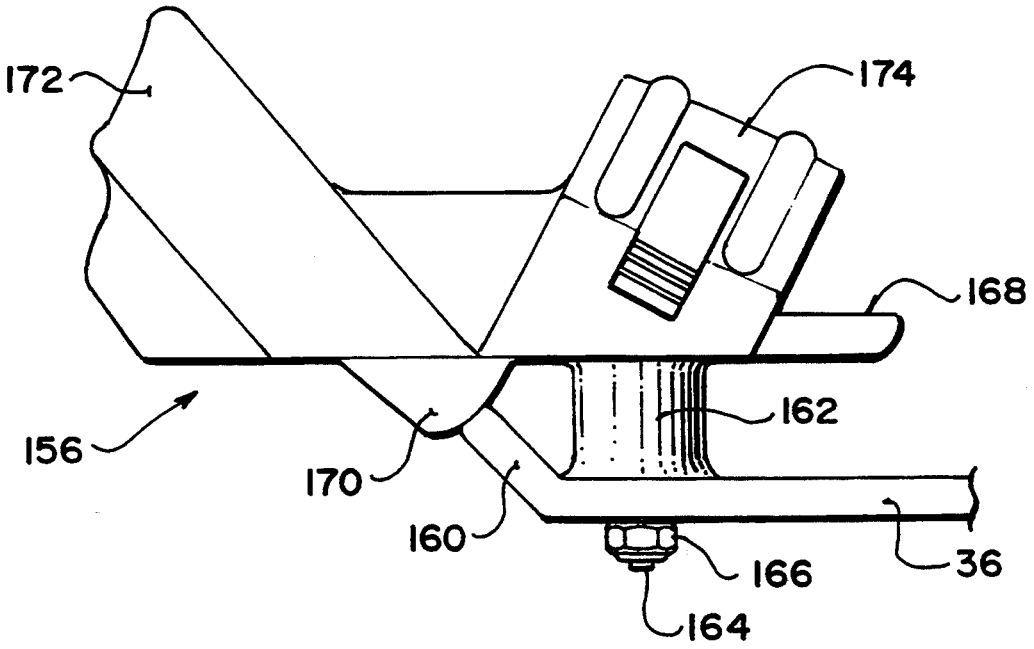
FIG. 7 is a side elevation of a foot pad.

A foot pad assembly for the apparatus is illustrated in FIG. 7. The assembly 156 includes the support arm 36 which is illustrated as having an upturned end 160. A resilient elastomeric pedestal 162 is mounted on the support arm 36 immediately in front of the upturned end 160. It is secured in place using a stud 164 and a nut 166. A sole plate 168 of the foot pad is mounted on the top end of the pedestal. To the rear of the pedestal, the sole plate has an-abutment 170 that engages the upturned end of the support arm 36 to limit the downward movement of the heel of the foot pad. The sole plate carries an integral heel cup 172 and a toe strap 174 that is adjustable to grip shoes of different sizes.

In use of the apparatus, a user straps his feet into the foot pads and grasps the handle bars. The handle bars may be adjusted fore and aft to suit the stature or comfort of the user. The stride length may also be adjusted using the adjustment knobs 142 on the resistance units 56. The feet are then moved fore and aft alternately to follow a natural skating motion against the resistance of the resistance units. This resistance can be adjusted as necessary or desired using the adjustment knobs 86 on the console 84. It will therefore be seen that the present invention provides an apparatus that is particularly effective as a leg exercising device and particularly for exercising those muscles used in ice skating. Because of the adjustability of the apparatus, it is suited to almost any individual and may be used for progressive training or therapy as desired.

While particular embodiments of the present invention have been described in the foregoing, it is to be understood that other embodiments are possible within the scope of the invention. The invention is to be considered limited solely by the scope of the appended claims.

We claim:

1. An exercise apparatus comprising:

a frame;

two first arms pivotally connected to the frame;

two second arms pivotally connected to respective ones of the first arms at positions spaced from the connections of the first arms to the frames;

two tie rods, each pivotally connected to the frame and a respective one of the second arms so as to provide, with the first and second arms and the frame, two four bar linkages;

a foot pad mounted on each second arm; and resistance means comprising two fluid cylinders, each connected between the frame and a respective one of the first arms for resisting pivotal movement of each first arm with respect to the frame, each fluid cylinder being a double acting cylinder comprising:

a cylinder barrel;

fluid port means at each end of the cylinder barrel;

one-way valve means communicating with each fluid port means for passing fluid into the cylinder barrel and preventing fluid flow from the cylinder barrel;

adjustable control valve means connected to the fluid port means for controllably restricting flow from the fluid port means;

a piston slideable in the barrel and a piston rod secured to the piston and projecting from one end of the barrel; means for pivotally connecting the cylinder to the frame and means for pivotally connecting the piston rod to the associated first arm; stop means for limiting the stroke of the piston in the cylinder barrel, the stop means, comprising a rod projecting into the cylinder barrel from an end thereof opposite the piston rod for engagement with the piston.

2. An apparatus according to claim 1 wherein the cylinder is an hydraulic cylinders.

3. An apparatus according to claim 2 including a reservoir for hydraulic fluid.

4. An apparatus according to claim 3 wherein the one-way valve means communicate between the associated fluid port means and the reservoir.

5. An apparatus according to claim 4 wherein the control valve means are connected to the fluid port means and the reservoir.

6. An apparatus according to claim 5 wherein the flow control valve means comprise a single adjustable restrictor valve connected to the fluid port means at both ends of each cylinder barrel and one-way valves passing fluid from the port means to the adjustable restrictor valve and preventing flow from the restrictor valve to the port means.

7. An apparatus according to claim 6 wherein the flow control valve means comprise two independently adjustable restrictor valves connected to the respective fluid port means at opposite ends of each cylinder barrel.

8. An apparatus according to claim 3 wherein the reservoir comprises a tube surrounding the cylinder barrel.

9. An apparatus according to claim 4 including handle bars comprising a standard projecting upwardly from the frame, wherein the flow control valve means are mounted on the standard.

10. An apparatus according to claim 1 including handle bars comprising a standard projecting upwardly from the frame and hand grips on the standard, characterized by means for adjusting the inclination of the standard with respect to the frame.

11. An apparatus according to claim 1 including stop means for limiting the pivotal movement of the first arms with respect to the frame.

12. An apparatus according to claim 11 wherein the stop means are adjustable.

13. An apparatus according to claim 1 wherein the stop means are adjustable.

14. An apparatus according to claim 1 wherein each tie rod is pivotally connected to the frame at a position adjacent to and laterally outside of the pivotal connection of the associated first arm to the frame.

15. An apparatus according to claim 14 wherein the tie rod is pivotally connected to the second arm at a position between the foot pad and the pivotal connection of the second arm to the first arm.

16. An apparatus according to claim 15 wherein the tie rod is pivotally connected to the second arm adjacent a position midway between the pivotal connection of the second arm to the first arm and the foot pad.

* * * * *